8/12/86 XR 4,605,066

United States Patent [19]

Djabbarah

[11] Patent Number: 4,605,066

[45] Date of Patent: Aug. 12, 1986

[54] OIL RECOVERY METHOD EMPLOYING CARBON DIOXIDE FLOODING WITH IMPROVED SWEEP EFFICIENCY

[75] Inventor: Nizar F. Djabbarah, Richardson, Tex.

[73] Assignee: Mobil Oil Corporation, New York, N.Y.

[21] Appl. No.: 593,465

[22] Filed: Mar. 26, 1984

[51] Int. Cl.[4] ..... E21B 43/22

[52] U.S. Cl. ..... 166/273; 166/274

[58] Field of Search ..... 166/273, 274, 285

[56] References Cited

U.S. PATENT DOCUMENTS

| | | | |
|---|---|---|---|
| 2,875,830 | 3/1959 | Martin | 166/273 X |
| 3,084,743 | 4/1963 | West et al. | 166/273 |
| 3,191,675 | 6/1965 | Gilchrist | 166/273 |
| 3,262,498 | 7/1966 | Connally, Jr. et al. | 166/273 |
| 3,497,007 | 2/1970 | Williams et al. | 166/273 |
| 3,811,503 | 5/1974 | Burnett et al. | 166/274 X |
| 3,856,086 | 12/1974 | Braden, Jr. | 166/273 X |
| 4,299,286 | 11/1981 | Alston | 166/274 |

FOREIGN PATENT DOCUMENTS

| | | |
|---|---|---|
| GB2142958A | 1/1985 | United Kingdom . |
| GB2142957A | 1/1985 | United Kingdom . |

*Primary Examiner*—Stephen J. Novosad
*Assistant Examiner*—Bruce M. Kisliuk
*Attorney, Agent, or Firm*—Alexander J. McKillop; Michael G. Gilman; Stanislaus Aksman

[57] ABSTRACT

Oil is recovered from oil-containing formations employing alternate injection of carbon dioxide and a mixture of carbon dioxide and an additive comprising an intermediate hydrocarbon or tall oil to improve sweep efficiency. First, carbon dioxide is injected and fluid including oil is recovered from the formation until $CO_2$ breakthrough occurs at the production well. Next, a mixture of carbon dioxide and an intermediate hydrocarbon or carbon dioxide and tall oil is injected and fluids produced until the injection pressure increases to a value about 10% above the injection pressure when injection of the mixture is initiated. Thereafter, carbon dioxide is injected and fluids including oil are recovered until carbon dioxide breakthrough occurs at the production well. The sequence of injection of carbon dioxide followed by injection of a mixture of carbon dioxide and an intermediate hydrocarbon or carbon dioxide and tall oil is repeated for a plurality of cycles to more completely sweep the full volume of the formation defined by the injection and production well. The process should be applied to a formation in which adequate communication exists.

7 Claims, No Drawings

OIL RECOVERY METHOD EMPLOYING CARBON DIOXIDE FLOODING WITH IMPROVED SWEEP EFFICIENCY

FIELD AND BACKGROUND OF THE INVENTION

Field of the Invention

This invention relates to the recovery of oil from subterranean, oil-containing, permeable formations and more particularly to an improved carbon dioxide flooding process employing alternate injection of carbon dioxide and a mixture of carbon dioxide and an additive comprising an intermediate hydrocarbon or tall oil to increase sweep efficiency.

Background of the Invention

When a well is completed in a subterranean reservoir, the oil present in the reservoir is normally removed through the well by primary recovery methods. These methods include utilizing native reservoir energy in the form of water or gas existing under sufficient pressure to drive the oil from the reservoir through the well to the earth's surface. This native reservoir energy most often is depleted long before all of the oil present in the reservoir has been removed from it. Additional oil removal has been effected by secondary recovery methods of adding energy from outside sources to the reservoir either before or subsequent to the depletion of the native reservoir energy.

Miscible phase displacement techniques comprise a form of enhanced recovery in which there is introduced into the reservoir through an injection well a fluid or fluids which are miscible with the oil in the reservoir at the temperature and pressure of the reservoir and serve to displace the oil from the pores of the reservoir and drive it to a production well. The miscible fluid is introduced into the injection well at a sufficiently high pressure that the body of fluid may be driven through the reservoir where it collects and drives the reservoir oil to the production well.

The process of miscible flooding is extremely effective in stripping and displacing the reservoir oil from the reservoir through which the solvent flows. This effectiveness is derived from the fact that a two-phase system within the reservoir and between the solvent and the reservoir is eliminated at the conditions of temperature and pressure of the reservoir, thereby eliminating the retentive forces of capillarity and interfacial tension which are significant factors in reducing the recovery efficiency of oil in conventional flooding operations where the displacing agent and the reservoir oil exist as two phases in the reservoir.

More recently, carbon dioxide has been used successfully as a miscible oil recovery agent. Carbon dioxide is a particularly desirable material because it is highly soluble in oil, and dissolution of carbon dioxide in oil causes a reduction in the viscosity of the oil and increases the volume of oil, all of which improve the recovery efficiency of the process. Carbon dioxide is also employed under non-miscible conditions, and in certain reservoirs it is possible to achieve a condition of miscibility at reservoir temperature and pressure between essentially pure carbon dioxide and the oil.

In carrying out a carbon dioxide miscible flood oil recovery process, channeling and override problems are common which result in a nonuniform flood front. The uniformity to which the flood pattern, that is, the pattern assumed by the body of displacing liquid, may be held is generally referred to as the sweep efficiency. Channeling is due to the high mobility ratio of the displacing fluid (carbon dioxide) and the low mobility of the displaced fluid (oil). It can also be caused by high permeability zones (thief zones) which could exist in the formation. The override effect occurs because of the density difference between the carbon dioxide and the oil. When either of these phenomena occurs, carbon dioxide tends to break through early at the production wells and bypass a considerable volume of the formation.

U.S. Pat. No. 3,497,007 to Williams et al discloses a miscible drive oil recovery process comprising first injecting a polar organic solvent such as low molecular weight alcohols containing a tall oil additive followed by injecting an aqueous solution of a surfactant followed by flood water.

U.S. Pat. No. 3,811,503 describes an oil recovery process employing carbon dioxide in a situation in which pure carbon dioxide is not conditionally miscible with the formation petroleum at the formation temperature and pressure, in which sufficient intermediate hydrocarbons are blended with carbon dioxide to ensure that the injected mixture is conditionally miscible with the formation petroleum at the formation temperature and pressure.

The present invention provides an improved method for the recovery of oil from a subterranean, oil-containing formation employing alternate injection of carbon dioxide and a mixture of carbon dioxide and an additive comprising an intermediate hydrocarbon or tall oil that improves sweep efficiency thereby enhancing oil recovery.

SUMMARY

The present invention relates to a method for recovering oil from a subterranean, oil-containing, permeable formation penetrated by at least one injection well and by at least one production well, both wells being in fluid communication with the formation, comprising injecting carbon dioxide into the formation via the injection well and recovering fluid including oil from the formation via the production well until carbon dioxide breakthrough occurs at the production well, thereby forming a $CO_2$-swept zone in the formation. Next, a mixture of carbon dioxide and an additive comprising an intermediate hydrocarbon or tall oil is injected into the $CO_2$-swept zone via the injection well and fluid including oil is recovered from the formation via the production well until the injection pressure increases to a value about 10% above the injection pressure at the initial injection of said mixture. Thereafter, carbon dioxide is injected into the formation via the injection well and fluids recovered including oil from the formation via the production well until carbon dioxide breakthrough occurs at the production well. Alternate injection of carbon dioxide and a mixture of carbon dioxide and an intermediate hydrocarbon or carbon dioxide and tall oil may be repeated for a plurality of cycles.

DESCRIPTION OF THE PREFERRED EMBODIMENTS

This invention relates to a method for the recovery of oil employing carbon dioxide with improved sweep efficiency. More particularly, the method is applied to a subterranean, permeable, oil-containing formation penetrated by at least one injection well and at least one spaced-apart production well. The injection well and production well are perforated to establish fluid communication with a substantial portion of the formation.

While recovery of the type contemplated by the present invention may be carried out by employing only two wells, it is to be understood that the invention is not limited to any particular number of wells. The invention may be practiced using a variety of well patterns as is well known in the art of oil recovery, such as an inverted five spot pattern in which an injection well is surrounded with four production wells, or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al, the disclosure of which is hereby incorporated by reference. Either naturally occurring or artifically induced fluid communication should exist between the injection well and the production well. Adequate fluid communication may be accomplished by fracturing procedures well known in the art.

In the first step of the invention carbon dioxide is injected into the formation via the injection well and fluid including oil is recovered from the formation via the production well. The carbon dioxide preferably is introduced into the injection well in the liquefied state because less energy is required than when handling it in the gaseous state. As the liquid carbon dioxide descends in the wellbore, it undergoes a naturally increasing temperature, causing it to become gaseous either in the wellbore or in the formation in the immediate vicinity of the wellbore. The injected carbon dioxide displaces the in-place formation oil through the formation toward the production well and since it is highly soluble in the oil, it dissolves into the oil, thereby reducing its viscosity. In addition to the viscosity reduction which mobilizes the oil, there is a preferential extraction from the oil by the carbon dioxide of light intermediate hydrocarbons containing from 2 to 5 carbon atoms, thereby developing an intermediate-rich carbon dioxide bank in the vicinity of the line of contact between the formation oil and the carbon dioxide. Depending upon the composition of the formation fluids, particularly as to amount of intermediate, and under proper conditions of temperature and pressure in the formation, the intermediate-rich carbon dioxide bank may be completely miscible with the formation oil thereby resulting in miscible displacement. Further, there is a swelling of the formation oil by virtue of the dissolving of the carbon dioxide in it. Since the density of the carbon dioxide is much less than the density of the oil in most reservoirs, the carbon dioxide has a tendency to migrate upward through the formation resulting in premature breakthrough at the production well thereby creating a high permeability $CO_2$-swept zone. Once the high permeability $CO_2$-swept zone has been established connecting the injection well and production well, further injection of carbon dioxide into the formation will result in carbon dioxide passing only through the $CO_2$-swept zone and consequently displacing very little additional viscous oil from the portions of the formation below the $CO_2$-swept zone.

Therefore, once carbon dioxide breakthrough occurs at the production well, a fluid mixture of carbon dioxide and an intermediate hydrocarbon or carbon dioxide and tall oil is injected into the formation via the injection well and fluid including oil is produced from the production well. The injected fluid mixture passes through the $CO_2$-swept zone and significantly reduces the permeability of that zone thus forcing the fluid mixture to invade portions of the oil-containing formation located below the original $CO_2$-swept zone of the formation. As the permeability of the $CO_2$-swept zone increases, the pressure required to inject the fluid mixture into the swept zone increases. Once the injection pressure of the fluid mixture increases to a value above about 10% of the pressure at initiation of injection of the fluid mixture, injection of the fluid mixture is terminated.

Thereafter, carbon dioxide is injected into the formation via the injection well and fluid including oil is recovered from the formation via the production well until carbon dioxide breakthrough occurs at the production well. The sequence of injecting carbon dioxide until $CO_2$ breakthrough occurs at the production well followed by injection of a mixture of carbon dioxide and an intermediate hydrocarbon or tall oil until the injection pressure increases to a predetermined level is repeated for a plurality of cycles. Repetitive cycles result in sweeping a very significant percentage of the formation and if the injected carbon dioxide or fluid mixture of carbon dioxide and intermediate hydrocarbon or carbon dioxide and tall oil is completely miscible with the formation oil at the pressure and temperature of the formation, then miscible flooding will occur thereby enhancing oil recovery. The repetitive cycles are continued either until all of the oil has been displaced from the formation or until the amount of oil recovered is uneconomical.

The intermediate hydrocarbon mixed with the carbon dioxide may be any aliphatic hydrocarbon in the $C_2$–$C_6$ range such as ethane, propane, butane, pentane and hexane, including mixtures thereof. The operable concentration range of intermediate hydrocarbon in the hydrocarbon-carbon dioxide mixture is within the range of 5 to 20% by volume.

The tall oil, which is a major inexpensive by-product of the paper industry, is obtained by reacting black liquor soap with sulfuric acid and water. A typical composition of crude tall oil is about 50% long chain fatty acids, 40% rosins and 10% sterols (long chain cyclic alcohols such as cholesterol). Tall oil is highly soluble in crude oil and negligibly soluble in water. The preferred concentration of tall oil in the tall oil-carbon dioxide mixture is within the range of 0.01 to 1.0 pounds/1000 SCF of $CO_2$.

What is claimed is:

1. A method of recovering oil from a subterranean, oil-containing, permeable formation penetrated by at least one injection well and by at least one production well, both wells being in fluid communication with the formation, comprising steps (a) through (d) in the recited sequence:

(a) injecting carbon dioxide into the formation through the injection well and recovering fluid including oil from the formation through the production well until carbon dioxide breakthrough occurs at the production well, thereby forming a $CO_2$-swept zone in the formation;

(b) subsequently injecting a mixture of carbon dioxide and an intermediate hydrocarbon into the $CO_2$-swept zone through the injection well, thereby decreasing the permeability of the $CO_2$-swept zone and increasing the pressure required to inject the mixture into the $CO_2$-swept zone, and recovering fluid including oil from the formation through the production well until the injection pressure increases to a value about 10% above the injection pressure at the initiation of the injection of said mixture;

(c) thereafter injecting $CO_2$ into the formation through the injection well and recovering fluid including oil from the formation through the production well until carbon dioxide breakthrough occurs at the production well; and (d) thereafter repeating steps (b) and (c) for a plurality of cycles.

2. The method of claim 1 wherein the intermediate hydrocarbon is selected from the group consisting of ethane, propane, butane, pentane, hexane and mixtures thereof.

3. The method of claim 1 wherein the concentration of said intermediate hydrocarbon is within the range of 5 to 20% by volume.

4. A method of recovering oil from a subterranean, oil-containing, permeable formation penetrated by at least one injection well and by at least one production well, both wells being in fluid communication with the formation, comprising steps (a) through (d) in the recited sequence:

(a) injecting carbon dioxide into the formation through the injection well and recovering fluid including oil from the formation through the production well until carbon dioxide breakthrough occurs at the production well, thereby forming a $CO_2$-swept zone in the formation;

(b) subsequently injecting a mixture of carbon dioxide and tall oil into the $CO_2$-swept zone through the injection well, thereby decreasing the permeability of the $CO_2$-swept zone and increasing the pressure required to inject the mixture into the $CO_2$-swept zone, and recovering fluid including oil from the formation through the production well until the injection pressure increases to a value about 10% above the injection pressure at the initiation of the injection of said mixture;

(c) thereafter injecting $CO_2$ into the formation through the injection well and recovering fluid including oil from the formation through the production well until carbon dioxide breakthrough occurs at the production well; and (d) thereafter repeating steps (b) and (c) for a plurality of cycles.

5. The method of claim 4 wherein the concentration of said tall oil is within the range of 0.01 to 1.0 lbs./1000 SCF of $CO_2$.

6. The method of claim 3 wherein the carbon dioxide injected into the formation is in a liquid state.

7. The method of claim 5 wherein the carbon dioxide injected into the formation is in a liquid state.

* * * * *